United States Patent [19]

Sato et al.

[11] Patent Number: 4,908,073

[45] Date of Patent: Mar. 13, 1990

[54] METHOD OF PRODUCING A COLD ROLLED STEEL SHEET HAVING A GOOD AGEING RESISTANCE AND SMALL ANISOTROPY AND ADAPTED FOR DEEP DRAWING

[75] Inventors: Susumu Sato; Osamu Hashimoto; Toshio Irie; Nobuo Matsuno, all of Chiba, Japan

[73] Assignee: Kawasaki Steel Corporation, Kobe, Japan

[21] Appl. No.: 161,315

[22] Filed: Feb. 23, 1988

Related U.S. Application Data

[63] Continuation of Ser. No. 898,889, Aug. 21, 1986, abandoned, which is a continuation of Ser. No. 693,327, Jan. 22, 1985, abandoned, which is a continuation of Ser. No. 478,525, filed as PCT JP82/00310 on Aug. 9, 1982, published as WO83/00507 on Feb. 17, 1983, abandoned.

[30] Foreign Application Priority Data

Aug. 10, 1981 [JP] Japan ..... 56-124936

[51] Int. Cl.[4] ..... C21D 9/48

[52] U.S. Cl. ..... 148/12 C; 148/12 F; 148/134

[58] Field of Search ..... 148/12 C, 36, 12 B, 148/12.4, 12 R, 126, 125, 127, 12 F, 14, 134

[56] References Cited

U.S. PATENT DOCUMENTS 4,315,783 2/1982 Akisue et al. ..... 148/12 C
4,331,488 5/1982 Sudo et al. ..... 148/36
4,336,080 6/1982 Nakaoka et al. ..... 148/12 C
4,339,284 7/1982 Hashimoto et al. ..... 148/36
4,368,084 1/1983 Irie et al. ..... 148/36

FOREIGN PATENT DOCUMENTS 137021 11/1978 Japan ..... 148/12 C
104417 8/1979 Japan ..... 148/12 C

*Primary Examiner*—Deborah Yee
*Attorney, Agent, or Firm*—Balogh, Osann, Kramer, Dvorak, Genova & Traub

[57] ABSTRACT

The present invention relates to the production of a cold rolled steel sheet having good ageing resistance and small anisotropy and adapted for deep drawing, which properties can satisfy concurrently the demands for the deep drawability and ageing resistance of the cold rolled steel sheet to be pressed and used for automotive exterior plate. The present invention has concurrently and satisfactorily solved the problems in the above described good ageing resistance and anisotropy, which problems had not hitherto been solved in the conventional method, by a method wherein a cold rolled steel sheet having such a limited composition that contains not more than 0.004% of C, 0.002–0.010% of a total amount of at least one element selected from Nb, Ti, V, Zr and W, and further occasionally contains not more than 0.0050% of B, is subjected to a continuous annealing at a temperature within the range of 700–950° C. in the production of the cold rolled steel sheet according to the conventional method. The steel sheet obtained in the present invention can be advantageously used as a thin steel sheet adapted to be pressed, for example, into an automotive exterior plate.

4 Claims, 3 Drawing Sheets

| Line | Sample Steel No. | Heat Cycle |
|---|---|---|
| Continuous Annealing Line | 1<br>2<br>9<br>10 |  |
| | | |
| | 4<br>8 |  |
| Continuous Hot - Dip Zinc Plating Line | 3<br>6 |  |

METHOD OF PRODUCING A COLD ROLLED STEEL SHEET HAVING A GOOD AGEING RESISTANCE AND SMALL ANISOTROPY AND ADAPTED FOR DEEP DRAWING

This application is a continuation of application Ser. No. 06/898,889 filed 8-21-86 which is a continuation of application Ser. No. 06/693,327 filed 1/22/85 which is a continuation of application Ser. No. 06/478,525 filed as PCT JP82/00310 on Aug. 9, 1982, published as WO83/00507 on Feb. 17, 1983, all now abandoned.

FIELD OF INVENTION

The present invention relates to a method of producing a cold rolled steel sheet having good ageing resistance and small anisotropy and adapted for deep drawing.

Cold rolled steel sheets, which are used for an automotive exterior plate and the like, are generally required to have deep drawability and good ageing resistance.

Among various properties of a steel sheet, the Lankford value, that is, so-called r value, of the steel sheet has a highest influence upon its deep drawability, and further its elongation (El) and the like have a minor influence upon its deep drawability. While, when solute C and N are present in a steel sheet, a trouble which is called as stretcher strain is apt to occur during the pressing due to the ageing at room temperature, and therefore steel sheets for press forming are demanded to have a good ageing resistance.

BACKGROUND OF THE INVENTION

There has been known a method of producing a non-ageing cold rolled steel sheet for deep drawing by the use of a low carbon aluminium killed steel. In this method, a high r value is obtained in the resulting cold rolled steel sheet by the action of AlN precipitated during the heating in a box annealing, and at the same time N is precipitated and fixed by Al, and C is precipitated and fixed in the form of $Fe_3C$ to give a non-ageing property to the resulting steel sheet. As another method of producing a cold rolled steel sheet with a good ageing resistance, there has been known a method wherein decarburization and denitrogenization are carried out by an open coil annealing.

Both the above described methods are carried out by a batch system, and therefore these methods are inferior to continuous annealing method in the productivity and are poor in the homogeneity of the annealed steel sheet. Moreover, in these methods, a long period of time of heat treatment is carried out, and therefore temper color is apt to develop on the surface of steel sheet due to the enrichment of Si, Mn and the like. Further, when decarburization or denitrogenization is carried out, the decarburized or denitrogenized steel sheet shows the cold-work embrittleness due to the segregation of P in the grain boundary during the slow cooling.

While, the continuous annealing method is free from the drawbacks of the above described batch annealing method. However, in the continuous annealing method, a cycle consisting of a rapid heating, a short time soaking and a rapid cooling is carried out, and therefore as far as a low carbon steel is used, the continuous annealing method cannot develop fully crystal grains and is inferior to the batch method in the ductility and r value of the resulting steel sheet, and is more difficult than the batch method in the fixing of C and N and in the production of non-ageing steel sheet.

In order to obviate the above described drawbacks of the continuous annealing method, various methods for producing a cold rolled steel sheet having a satisfactory property from an extra-low carbon aluminium killed steel even by a continuous annealing cycle have been disclosed. Japanese Patent Application Publication No. 17,490/76, Japanese Patent Laid-Open Application No. 58,333/80 and the like disclose these methods. However, these methods still have the following drawbacks.

(A) It is difficult to produce a steel sheet having substantially non-ageing property unless an extra-low carbon aluminium killed steel having a C content of not higher than 20 ppm is used.

(B) Even in the use of a steel having a C content of as low as not higher than 20 ppm, the resulting steel sheet still has a large planar anisotropy in the r value, elongation and the like, and has a problem for practical use.

While, as a method for producing a steel sheet having excellent deep drawability and ageing resistance and further having small anisotropy, there have been known methods, wherein C and N contained in the steel are precipitated and fixed by using powerful elements for forming carbide or nitride, such as Ti, Nb and the like. The use of Ti is disclosed in Japanese Patent Application Publication No. 12,348/67, and the use of Nb is disclosed in Japanese Patent Application Publication No. 35,002/78. However, in these methods, when a steel contains a large amount of C, the resulting steel sheet is poor in the ductility due to a large amount of precipitates; and reversely when a steel contains a small amount of not more than 50 ppm of C, the C cannot be fully precipitated and fixed unless Ti or the like is used in an amount considerably larger than the stoichiometrically necessary amount for fixing the C. Therefore, unbonded excess Ti and the like also deteriorate the ductility of the resulting steel sheet, and affect adversely the formability of the steel sheet.

Further, Japanese Patent Laid-Open Application No. 81,913/75 discloses a method of securing excellent property in the resulting steel sheet, wherein a very small amount of at least one of B, Nb, Zr, V and Ti is added to a low-carbon aluminium killed steel having a C content of 0.05–0.07%, the steel is formed into a steel sheet, the steel sheet is subjected to a recrystallization annealing, and the annealed steel sheet is subjected to an overageing treatment at a temperature not lower than 300° C. to precipitate the major part of C contained in the steel. However, this method treats always a low carbon steel, and an overageing treatment must be carried out in the continuous annealing.

Further, the inventors have already disclosed a cold rolled steel having ultra-deep drawability, which consists of an extra-low carbon aluminium killed steel having a C content of 0.004–0.006% and an Nb content of 0.026–0.043%, and a method of producing the steel sheet in Japanese Patent Laid-Open Application No. 169,752/81; and further disclosed a high tensile strength steel sheet having ultra-deep drawability, which consists of an extra-low carbon aluminium killed steel having a C content of 0.005–0.009%, an Nb content of 0.027–0.043% and a P content of 0.062–0.082%, and a method of producing the steel sheet in Japanese Patent Laid-Open Application No. 139,654/81. However, the present invention is different from these Japanese laid-open applications in the following two points of (a) $C \leqq 0.004\%$ and (b) Nb and other elements $\leqq 0.01\%$.

The object of the present invention is to solve the above described drawbacks of the conventional technics, and to provide a method of producing a cold rolled steel sheet having good ageing resistance and small anisotropy and adapted for deep drawing.

SUMMARY OF THE INVENTION

The first aspect of the present invention lies in a method of producing a cold rolled steel sheet having good ageing resistance and small anisotropy and adapted for deep drawing, including subjecting a cold rolled steel sheet having a composition consisting of, in weight ratio, not more than 0.004% of C, 0.03–0.30% of Mn, not more than 0.150% of P, not more than 0.020% of S, not more than 0.007% of N, 0.005–0.150% of acid-soluble Al, 0.002–0.010% of a total amount of at least one element selected from Nb, Ti, V, Zr and W, and the remainder being Fe and incidental impurities, to a continuous annealing at a temperature within the range of 700°–950° C.

The second aspect of the present invention lies in a method, wherein a cold rolled steel sheet having a composition consisting of the above described basic composition, not more than 0.0050% of B, and the remainder being Fe and incidental impurities is subjected to a continuous annealing in the same manner as described in the first aspect of the present invention.

That is, in the present invention, a cold rolled steel sheet having good ageing resistance and small anisotropy and adapted for deep drawing is produced by a method, wherein an aluminium killed steel having a composition containing not more than 0.004% of C and a very small amount of 0.002–0.010% of a total amount of at least one element selected from Nb, Ti, V, Zr and W, and occasionally containing not more than 0.0050% of B is hot rolled and then cold rolled in a conventional manner, and the cold rolled sheet is subjected to a continuous annealing at a temperature within the range of 700°–950° C.

An explanation will be made with respect to a basic experiment for the present invention. A steel having a composition shown in the following Table 1 was produced by means of an LD converter, and subjected to an RH degassing treatment and then to a continuous casting to produce a slab. The slab was hot rolled at a finishing temperature of 870°–910° C. and a coiling temperature of 660°–710° C., and the hot rolled sheet was cold rolled at a reduction rate of 75% by conventional manners to produce a steel sheet having a thickness of 0.8 mm.

TABLE 1

| Sample steel No. | Chemical composition (wt. %) | | | | | | | | |
|---|---|---|---|---|---|---|---|---|---|
| | C | Si | Mn | P | S | O | N | Al | Nb |
| 1 | 0.0010 | 0.01 | 0.15 | 0.011 | 0.007 | 0.0026 | 0.0021 | 0.061 | Tr. |
| | 0.0013 | 0.01 | 0.15 | 0.012 | 0.006 | 0.0020 | 0.0019 | 0.042 | 0.003 |
| | 0.0013 | 0.02 | 0.16 | 0.014 | 0.007 | 0.0035 | 0.0018 | 0.050 | 0.008 |
| | 0.0015 | 0.01 | 0.14 | 0.011 | 0.007 | 0.0030 | 0.0017 | 0.038 | 0.011 |
| 5 | 0.0009 | 0.02 | 0.14 | 0.011 | 0.007 | 0.0031 | 0.0026 | 0.027 | 0.021 |
| 6 | 0.0026 | 0.02 | 0.14 | 0.013 | 0.008 | 0.0028 | 0.0028 | 0.060 | Tr. |
| | 0.0030 | 0.01 | 0.15 | 0.012 | 0.009 | 0.0019 | 0.0032 | 0.056 | 0.005 |
| 8 | 0.0032 | 0.01 | 0.15 | 0.012 | 0.011 | 0.0032 | 0.0027 | 0.047 | 0.010 |
| | 0.0033 | 0.01 | 0.15 | 0.015 | 0.009 | 0.0026 | 0.0026 | 0.051 | 0.025 |

The above obtained steel sheet was subjected to a continuous annealing line, wherein the steel sheet was uniformly heated at a temperature of 800°–820° C. for about 40 seconds and then cooled substantially linearly to about room temperature at a cooling rate of 20° C./sec; and the above annealed steel sheet was subjected to a temper rolling at a reduction of 0.6% to produce a cold rolled steel sheet. The sample steels were classified into two groups depending upon the C content, and the relation between the properties, such as $\bar{r}$, El, ageing index AI, $\Delta r$ and $\Delta El$, of the resulting cold rolled steel sheet and the Nb content of the steel was investigated. As the result, it has been ascertained that the aimed object can be advantageously attained according to the present invention.

DETAILED DESCRIPTION OF THE INVENTION

Figure 1:
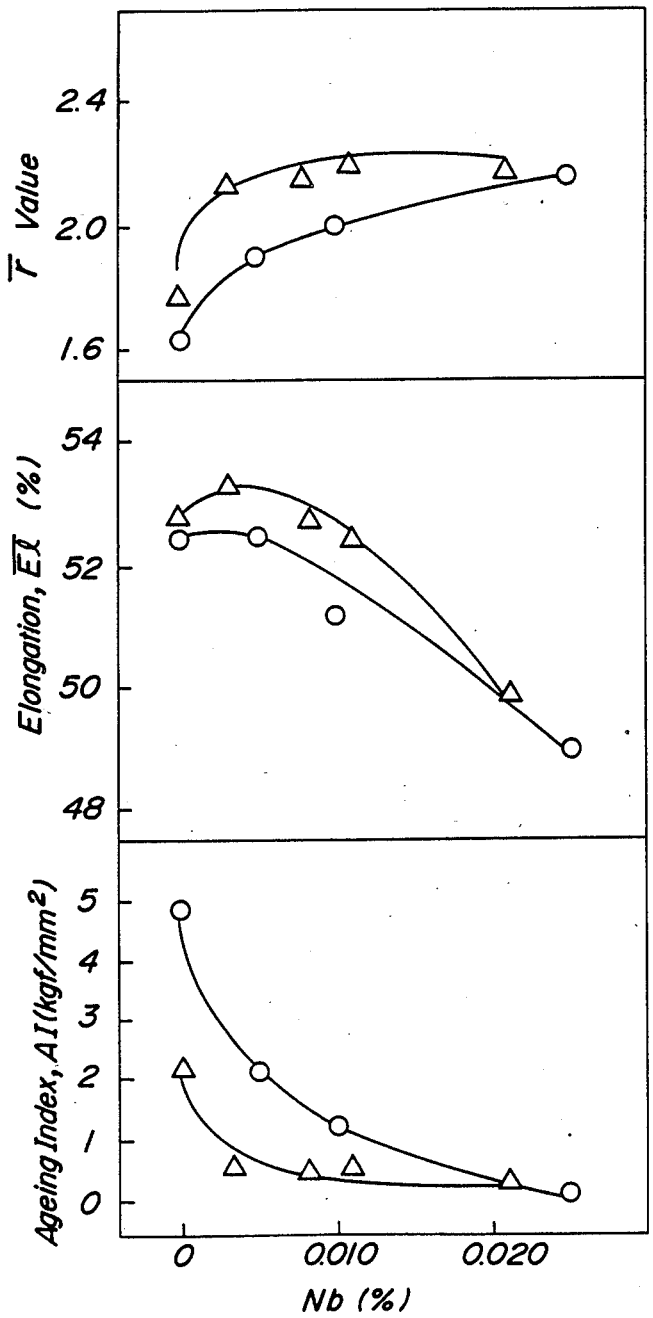
FIG. 1 and FIG. 2 illustrate the relations between the Nb content and $\bar{r}$, $\overline{El}$ and ageing index AI, and $\Delta r$ and $\Delta El$, respectively.
Figure 2:
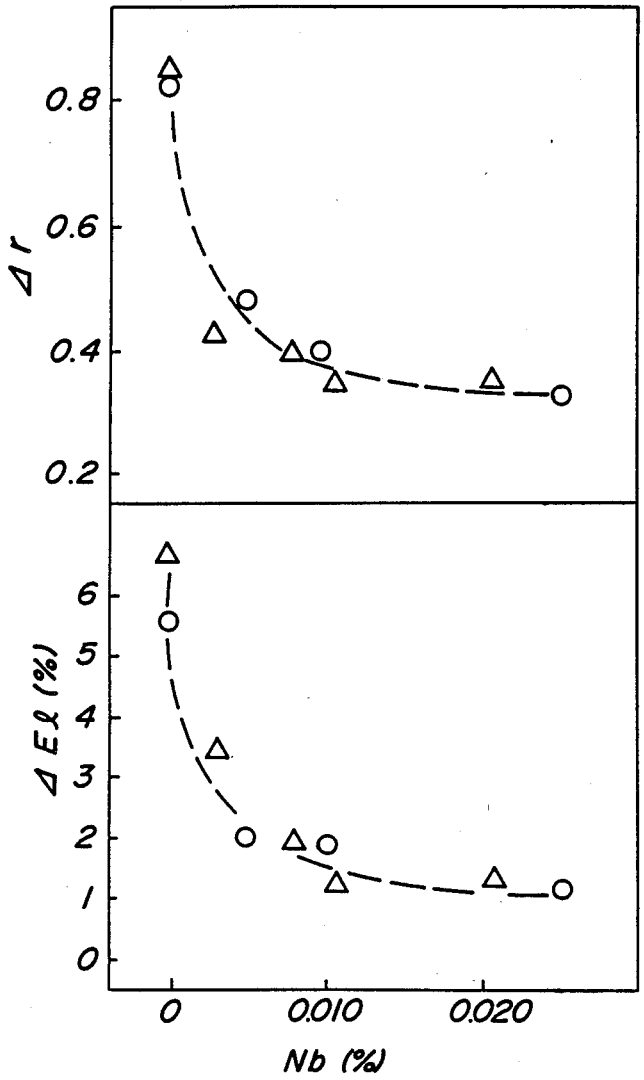

In FIG. 1 and FIG. 2, sample steels having a C content of 0.0009–0.0015% are indicated by the mark "Δ", and sample steels having a C content of 0.0026–0.0033% are indicated by the mark "o".

The ageing index AI is indicated by the difference between the flow stress of a steel sheet causing 7.5% of tensile pre-strain and the lower yield stress of the steel sheet when the steel sheet is subjected to a tensile force in a direction along the rolling direction after the flow stress has been removed and the steel sheet has been heat treated at 100° C. for 30 minutes.

The definition of the $\overline{El}$, and $\bar{r}$, and that of $\Delta El$ and $\Delta r$, which indicate the planar anisotropy of El and r value respectively, are as follows.

$$El = \frac{El_{0°} + 2El_{45°} + El_{90°}}{4}$$

$$r = \frac{r_{0°} + 2r_{45°} + r_{90°}}{4}$$

$$\Delta El = \frac{El_{0°} + El_{90°} - 2El_{45°}}{2}$$

$$\Delta r = \frac{r_{0°} + r_{90°} - 2r_{45°}}{2}$$

In the above formulae, $r_{0°}$ and $El_{0°}$ mean the r value and El when the angle of the direction of stress relative to the rolling direction is 0 degree.

It can be seen from FIGS. 1(A) and 1(C) that the r value and AI are remarkably improved independently of the C content by the addition of a very small amount of at least 0.002% of Nb. However, the addition of not less than 0.012% of Nb deteriorates the El as illustrated in FIG. 1(B).

While, in No. 1 steel having a C content of 0.0010% and containing no Nb, the resulting cold rolled steel sheet has a substantially non-ageing property having an AI of not more than 3 kgf/mm$^2$, and further has high El and r, that is, has aimed excellent properties. However, the steel sheet has a very high planar anisotropy in the r value and El. The inventors have found out that, when a very small amount of Nb is added to the steel, the resulting cold rolled steel sheet is very small in the ΔEl and Δr, and has a very small anisotropy.

Based on the discovery, the inventors have succeeded in the production of a cold rolled steel sheet having high El and r value and further having non-ageing property and small anisotropy by adding 0.002–0.010% of Nb to an extra-low carbon aluminium killed steel having a C content of 0.0009–0.0033%.

The inventors have made a further investigation and found out that the above described phenomenon occurs also even when at least one element of Ti, V, Zr and W alone or inadmixture is added to the steel in place of Nb, and further found out that, when B is further added to the above described steel containing at least one element of Nb, Ti, V, Zr and W, the ductility of the resulting steel sheet is improved, that is, the addition of B to a steel is effective for improving the property of the resulting steel sheet.

The reason why the addition of a very small amount of the above described elements, such as Nb and the like, to aluminium killed steel having a very low content of C gives excellent property to the resulting cold rolled steel sheet, is not clear, but is probably as follows. It would be firstly suspected that the effect is caused by the precipitates of these elements because these elements are all carbide- and nitride-former elements. However, the addition amount of these elements is small and moreover the C content in the steel is very low, and therefore it is suspected that it is very difficult to precipitate and fix completely C, and the effect is caused by the solute state of Nb and the like.

An explanation will be made hereinafter with respect to the reason for the limitation of the components constituting the steel of the present invention.

C: not more than 0.0040%

The C content in a steel must be not more than 0.0040% in order to obtain sufficiently high ductility, $\bar{r}$ value and ageing resistance in the steel by the continuous annealing method. While, it is not necessary to limit the lower limit of the C content. Because, the annealing is a continuous annealing and the cooling rate is high, and therefore the embrittle phenomenon of the steel due to P does not substantially occur.

Mn: 0.03–0.30%

The Mn content must be at least 0.03% in order to prevent the red shortness of the steel. However, when the Mn content exceeds 0.30%, the development of {111} recrystallization texture is disturbed to deteriorate the deep drawability of the steel. Therefore, the Mn content is limited to 0.03–0.30%.

P: not more than 0.150%

P has a high solid solution hardening ability, and can improve the tensile strength of steel in a very small addition amount and hardly deteriorates the deep drawability of the steel. Therefore, P is a very effective element in order to obtain a high tensile strength steel sheet having deep drawability. However, when the P content in a steel exceeds 0.150%, the spot weldability of the steel is poor. Therefore, the P content is limited to not more than 0.150%.

S: not more than 0.020%

When the S content in a steel exceeds 0.020%, the steel is very poor in the ductility. Therefore, the S content in a steel is limited to not more than 0.020%.

N: not more than 0.007%

N forms solid solution in a steel similarly to C and deteriorates the deep drawability, ageing resistance and the like. Therefore, the N content is limited to not more than 0.007%.

Acid-soluble Al: 0.005–0.150%

Acid-soluble Al must be contained in a steel in an amount of not less than 0.005% in order to remove oxygen and to fix N. However, when more than 0.150% of acid-soluble Al is contained in a steel, the steel is poor in the ductility, and inclusions in the steel increases. Therefore, the content of acid-soluble Al is limited to 0.005–0.150%.

Nb, Ti, V, Zr and W: 0.002–0.010%

The addition of these elements to steel is very important in the present invention. These elements have the same action in the point that, when not less than 0.002% of a total amount of these elements is added to an extra-low carbon aluminium killed steel, not only the deep drawability of the steel, but also the ageing resistance of the steel can be improved and the planar anisotropy in the r value, elongation and the like of the steel can be lowered. However, the addition amount of these elements to the steel exceeds 0.010%, the elongation of the steel deteriorates noticeably. Therefore, the content of these elements in steel is limited within the range of 0.002–0.010% in the total amount.

The above described elements are used, in an amount defined above, as basic elements in the cold rolled steel sheet for deep drawing of the present invention. Further, when B is additionally added to the cold rolled steel sheet, the object of the present invention can be attained more effectively. The reason of the limitation of the amount of B is as follows.

B: not more than 0.0050%

The addition of B alone to a steel deteriorates the deep drawability of the steel, and therefore B cannot be used alone. However, only when B is added to a steel together with the above described elements, such as Nb and the like, the yield strength of the steel is decreased and the elongation is improved without deteriorating the deep drawability of the steel, and the press formability of the steel is improved. B is preferably used in an amount of not less than 0.0010%, but when the amount of B exceeds 0.0050%, the effect of B is saturated. Therefore, the B content in a steel is limited to not more than 0.0050%.

An explanation will be made hereinafter with respect to the production step for a cold rolled steel sheet having the above described composition and having deep drawability. The steel making method is not particularly limited, but a combination system of converter method-degassing method is effectively used in order to produce a molten steel having a low C content of not more than 0.0040%. The molten steel can be formed into a slab by any of ingot making-slabbing method and continuous casting method. The hot rolling of the slab can be carried out by a hot strip mill under a commonly used condition. The finishing temperature is preferably not lower than 830° C., and the coiling temperature is preferably within the range of 400°–750° C. in view of the securing of the shape of the steel sheet and the easiness in the pickling.

The hot rolled steel strip is pickled and then subjected to a cold rolling. The cold rolling reduction rate of at least 50% is desirable in order to secure the deep drawability in the resulting cold rolled steel sheet.

It is necessary that the continuous annealing of cold rolled steel sheet is carried out at a temperature not lower than 700° C. When the heating temperature is lower than 700° C., recrystallized grains cannot be fully developed, and excellent workability cannot be obtained. While, when the heating temperature exceeds 950° C., the ductility and drawability are noticeably deteriorated. Therefore, the heating temperature at the continuous annealing is limited within the range of 700°-950° C., but a heating temperature within the range of 750°-900° C. is most preferable. The uniformly heating time in the continuous annealing of the cold rolled steel sheet is not particularly limited, but is preferably from 10 to 180 seconds in view of the securing of the aimed properties and the economical operation. The cooling method after the annealing is not particularly limited, but a gradual cooling from the uniformly heating temperature to about 700° C. is effective for improving the ageing resistance. Further, the cold-work embrittlement of the steel sheet can be easily prevented by a cooling method in an ordinary continuous annealing. However, it is not preferable that the heated steel sheet is gradually cooled at a rate of not higher than 0.1° C./sec or the heated steel sheet is kept for not less than 10 minutes at 700°-300° C. Moreover, even when the steel of the present invention is subjected to an overageing treatment in a continuous annealing line having an overageing zone, the properties of the steel is not substantially changed. Therefore, it is not necessary to carry out an overageing treatment, and it is not an important problem in the present invention whether or not an overageing treatment is carried out.

The annealed steel sheet in the present invention has an AI of not larger than 3 kgf/mm$^2$ and has a good ageing resistance. However, the steel sheet sometimes has a small amount of elongation at the yield point, and therefore the steel sheet can be additionally subjected to a temper rolling at a reduction of not more than 2%.

According to the present invention, a cold rolled steel sheet having good ageing resistance and small anisotropy and adapted for deep drawing was able to be produced by the above described treatment from an extra-low carbon aluminium killed steel containing a very small amount of Nb and the like added thereto.

Furthermore, the method of the present invention can be applied to the production of zinc-plated steel sheet by a continuous hot-dip zinc plating line including an annealing step in the line. The uniformly heating condition and the cooling method down to about 500° C. of the temperature of the zinc bath are same as those described above, and the cooling after the plating can be carried out by an optional method, and further the zinc-plated steel sheet can be subjected to an alloying treatment.

BEST MODE OF CARRYING OUT THE INVENTION

Example 1

Figure 3:
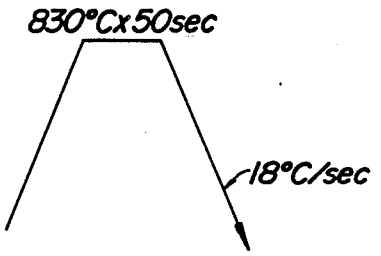
FIG. 3 shows diagrammatically heat cycles of continuous annealing line and continuous hot-dip zinc plating line.
Figure 3:
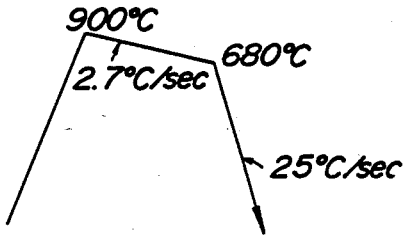
Figure 3:
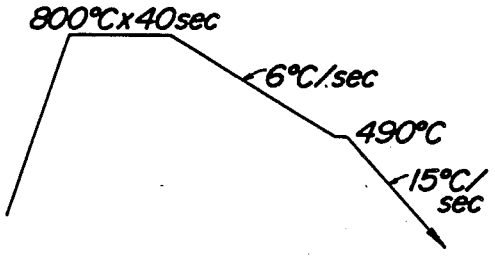

A steel having a composition shown in the following Table 2 was made into a hot rolld steel sheet at a hot rolling and coiling temperature shown in Table 2, and the hot rolled steel sheet was cold rolled into a cold rolled steel sheet. The cold rolled steel sheet was subjected to a continuous annealing line or continuous hot-dip zinc plating line by a heat cycle shown in FIG. 3. The following Table 3 shows the tensile properties, ageing resistance and cold-work embrittlement of the above treated steel sheet.

TABLE 2

| Sample steel No. | Chemical composition (wt. %) C | Si | Mn | P | S | N | Al | Others | | B | Hot rolling and coiling temperature (°C.) |
|---|---|---|---|---|---|---|---|---|---|---|---|
| 1 | 0.0008 | 0.010 | 0.14 | 0.011 | 0.007 | 0.0016 | 0.042 | Nb | 0.003 | — | 510 |
| 2 | 0.0030 | 0.010 | 0.06 | 0.010 | 0.008 | 0.0023 | 0.018 | Nb | 0.008 | — | 680 |
| 3 | 0.0018 | 0.010 | 0.06 | 0.010 | 0.008 | 0.0017 | 0.021 | Ti | 0.009 | — | 520 |
| 4 | 0.0031 | 0.013 | 0.14 | 0.013 | 0.005 | 0.0032 | 0.040 | Nb | 0.003 | — | 710 |
| | | | | | | | | Zr | 0.005 | | |
| 6 | 0.0022 | 0.016 | 0.16 | 0.008 | 0.003 | 0.0013 | 0.091 | V | 0.011 | — | 500 |
| 8 | 0.0011 | 0.011 | 0.12 | 0.009 | 0.008 | 0.0032 | 0.007 | Ti | 0.005 | 0.0045 | 670 |
| 9 | 0.0032 | 0.009 | 0.09 | 0.013 | 0.005 | 0.0058 | 0.031 | Nb | 0.003 | 0.0008 | 480 |
| | | | | | | | | V | 0.006 | | |
| 10 | 0.0014 | 0.012 | 0.18 | 0.082 | 0.007 | 0.0022 | 0.021 | Nb | 0.007 | — | 640 |

TABLE 3

| Sample steel No. | $\overline{YS}$, kgf/mm$^2$ | $\overline{TS}$, kgf/mm$^2$ | $\overline{El}$, % | Δ El, % | $\bar{r}$ | Δ r | AI*, kgf/mm$^2$ | Embrittle crack length**, mm | Sheet thickness, mm | Temper rolling reduction (%) |
|---|---|---|---|---|---|---|---|---|---|---|
| 1 | 14 | 29 | 52 | 2.8 | 2.06 | 0.22 | 1.2 | 0 | 0.8 | 0.5 |
| 2 | 15 | 30 | 50 | 3.3 | 2.11 | 0.37 | 2.5 | 0 | 0.8 | 0.5 |
| 3 | 15 | 28 | 51 | 4.0 | 1.96 | 0.45 | 2.0 | 0 | 0.8 | 0.6 |
| 4 | 16 | 31 | 48 | 1.5 | 2.17 | 0.22 | 0.2 | 0 | 0.8 | 0.6 |
| 6 | 16 | 30 | 51 | 0.6 | 2.05 | 0.15 | 0.6 | 0 | 0.8 | 0.3 |
| 8 | 14 | 27 | 53 | 2.2 | 1.98 | 0.25 | 2.8 | 0 | 0.8 | 0 |
| 9 | 15 | 28 | 52 | 3.2 | 2.12 | 0.36 | 2.2 | 0 | 0.8 | 0.6 |

TABLE 3-continued

| Sample steel No. | $\overline{YS}$, kgf/mm$^2$ | $\overline{TS}$, kgf/mm$^2$ | $\overline{El}$, % | Δ El, % | $\bar{r}$ | Δ r | AI*, kgf/mm$^2$ | Embrittle crack length**, mm | Sheet thickness, mm | Temper rolling reduction (%) |
|---|---|---|---|---|---|---|---|---|---|---|
| 10 | 20 | 36 | 45 | 1.5 | 2.10 | 0.32 | 2.6 | 0 | 0.7 | 0.5 |

*Ageing index indicated by the difference between the stress of a steel sheet causing 7.5% of tensile prestrain and the lower yield stress of the steel sheet when the steel sheet is subjected to a tensile force after the stress causing the tensile prestrain has been removed and the steel sheet has been heat treated at 100° for 30 minutes.

**The cold-work embrittlement was estimated by the length of a crack formed in a steel sheet by a treatment, wherein the steel sheet is subjected to a conical cup test according to JIS Z 2249 to be primarily worked into a conical shape, kept at 0° C. for 10 minutes and then subjected to a drop weight test under an impact energy of 5 kgf × 1 mm.

In any of the sample steels, a cold rolled steel sheet having excellent ageing resistance and deep drawability and having small anisotropy was able to be obtained.

Zinc-plated cold rolled steel sheets of samples Nos. 3 and 6 were able to be obtained without any troubles in the zinc-plating operation.

In sample steel No. 10 of a high tensile strength steel having a tensile strength of 35 kgf/mm$^2$ grade, the resulting cold rolled steel sheet has excellent ageing resistance and deep drawability.

It can be seen from the result of the above described Example that, according to the present invention, a cold rolled steel sheet having good ageing resistance and small anisotropy and adapted for deep drawing was able to be produced by adding a very small amount of Nb and other elements to an extra-low carbon steel and subjecting a cold rolled steel sheet obtained from the steel to a continuous annealing at a temperature within the range of 700°-950° C.

We claim:

1. A method of producing a cold rolled steel sheet having good ageing resistance and small anisotropy and adapted for deep drawing, comprising selecting a cold rolled steel sheet having a composition comprising, in weight ratio, 0.03-0.30% of Mn, not more than 0.150% of P, not more than 0.020% of S, not more than 0.007% of N, 0-005-0.150% of acid-soluble Al, and further comprising C and at least one element selected from Nb, V, Zr and W in such amounts that the amount of C is not more than 0.0028% and the total amount of at least one element of Nb, V, Zr and W is 0.002-0.008%, and the remainder being Fe and incidental impurities, and subjecting the sheet to a continuous annealing at a temperature within the range of 800°-950° C., and successively subjecting the sheet to cooling within the temperature range of 700°-300° C. in less than 10 minutes without overageing.

2. A method of producing a cold rolled steel sheet having good ageing resistance and small anisotropy and adapted for deep drawing, comprising selecting a cold rolled steel sheet having a composition comprising, in weight ratio, 0.03-0.30% of Mn, not more than 0.150% of P, not more than 0.020% of S, not more than 0.007% of N, 0.005-0.150% of acid-soluble Al, and further comprising C and at least one element selected from Nb, V, Zr and W in such amounts that the amount of C is not more than 0.0028% and the total amount of at least one of Nb, V, Zr and W is 0.002-0.008%, and the remainder being Fe and incidental impurities, and subjecting the sheet to a continuous annealing at a temperature of not higher than 950° C. and successively subjecting the sheet to cooling within the temperature range of 700°-300° C. in less than 10 minutes without overageing.

3. A method according to claim 1, comprising the step of selecting a steel sheet containing not more than 0.0050% by weight of B.

4. A method according to claim 2, comprising the step of selecting a steel sheet containing not more than 0.0050% by weight of B.

* * * * *